US009969174B2

(12) United States Patent
Yamaguchi et al.

(10) Patent No.: US 9,969,174 B2
(45) Date of Patent: May 15, 2018

(54) LIQUID CONTAINER TRAY AND LIQUID EJECTION DEVICE

(71) Applicant: SEIKO EPSON CORPORATION, Tokyo (JP)

(72) Inventors: Manabu Yamaguchi, Shiojiri (JP); Tadahiro Mizutani, Shiojiri (JP); Hiroyuki Kawate, Hokuto (JP); Hiroyoshi Ozeki, Shiojiri (JP); Kotoya Aruga, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/361,246

(22) Filed: Nov. 25, 2016

(65) Prior Publication Data

US 2017/0151799 A1 Jun. 1, 2017

(30) Foreign Application Priority Data

Nov. 27, 2015 (JP) ..... 2015-232004

(51) Int. Cl.
*B41J 2/175* (2006.01)
*B41J 29/02* (2006.01)

(52) U.S. Cl.
CPC ..... *B41J 2/17533* (2013.01); *B41J 2/17513* (2013.01); *B41J 2/17523* (2013.01); *B41J 29/02* (2013.01); *B41J 2002/17516* (2013.01)

(58) Field of Classification Search
CPC .... B41J 2/175; B41J 2/17503; B41J 2/17509; B41J 2/1752; B41J 2/17523; B41J 2/17533; B41J 2/17553; B41J 2/17559; B41J 2002/17516
See application file for complete search history.

(56) References Cited

U.S. PATENT DOCUMENTS 6,130,695 A * 10/2000 Childers ..... B41J 2/17506 347/85
6,705,714 B1 * 3/2004 Petranek ..... B41J 2/17503 347/85
7,237,880 B2 7/2007 Miyazawa et al.
7,293,864 B2 * 11/2007 Kimura ..... B41J 2/1752 347/85
8,870,349 B2 * 10/2014 Koizumi ..... B41J 2/17526 347/50
2011/0291349 A1 12/2011 Nemura et al.

FOREIGN PATENT DOCUMENTS

JP 3838373 B 8/2006
JP 2011-246252 A 12/2011

* cited by examiner

*Primary Examiner* — Anh T. N. Vo
(74) *Attorney, Agent, or Firm* — Foley & Lardner LLP

(57) ABSTRACT

Provided is a liquid ejection device including a liquid container tray that can suppress change in orientation and position of a liquid container on a support surface due to the difference in size of the liquid container.

The liquid ejection device includes: a casing including a guide wall: a liquid container tray configured to support a liquid container: and a recording head that ejects liquid supplied from the liquid container that is supported by the liquid container tray to a medium. The liquid container tray is configured to be inserted to or removed from a casing along the guide wall, and includes a support surface that supports the liquid container and a movable wall configured to move in at least one direction on the support surface.

19 Claims, 4 Drawing Sheets

LIQUID CONTAINER TRAY AND LIQUID EJECTION DEVICE

BACKGROUND

1. Technical Field

The present invention relates to a liquid ejection device such as an inkjet printer and a liquid container tray that is mounted, in a state of holding a liquid container, to the liquid ejection device.

2. Related Art

In liquid ejection devices such as an inkjet printer, liquid such as ink supplied from a liquid container via a liquid supply portion such as a liquid supply needle provided on the device side is ejected to a medium. In such liquid ejection devices, there are a liquid ejection devices that include a liquid container tray that holds the liquid container, and the liquid container tray can be attached to and removed from the liquid ejection device for improving convenience when the liquid container is replaced or the like. The liquid container tray includes a support surface that supports the liquid container and a side wall that protrudes from the entire edge of the support surface and surrounds the liquid container, and is mounted to the liquid ejection device such that the liquid container supported on the support surface is connected to a liquid supply portion on the device side (refer to Japanese Patent No. 3838373).

When the liquid container is to be replaced in the liquid ejection device, the liquid container tray is removed from the device by being moved such that the liquid container is separated from the liquid supply portion on the device side, and thereafter an old liquid container is removed from a portion surrounded by the side walls on the support surface of the liquid container tray. Next, after a new liquid container is inserted to the portion surrounded by the side walls on the support surface of the liquid container tray, the liquid container tray that supports the new liquid container is moved such that the liquid container is connected to the liquid supply portion on the device side, and is thereby attached to the liquid ejection device.

Incidentally, liquid containers of various sizes are used in the liquid ejection device, and some liquid containers are smaller than the portion surrounded by the side walls on the support surface. In this case, a gap is formed between the liquid container supported on the support surface and the side walls, and the orientation and position of the liquid container on the support surface may change due to the gap when the liquid container tray is attached to the liquid ejection device or the like. When a change in orientation and position of the liquid container on the support surface occurs, the change may adversely affect the favorable supply state of liquid from the liquid container.

SUMMARY

An advantage of some aspects of the invention is to provide a liquid ejection device that can suppress change in orientation and position of a liquid container on a support surface of a liquid container tray caused by a difference in size of the liquid container.

In one aspect of the invention, a liquid ejection device includes a casing including a guide wall, a liquid container tray configured to support a liquid container, and a recording head that ejects liquid supplied from the liquid container that is supported by the liquid container tray to a medium. A support surface that supports the liquid container, and a movable wall configured to move in at least one direction on the support surface are included. The liquid container tray is configured to be inserted to or removed from the casing along the guide wall. The liquid container tray includes a support surface that supports the liquid container and a movable wall configured to move in at least one direction on the support surface.

According to this configuration, as a result of moving the movable wall by selecting a position at which the movable wall comes into contact with the liquid container according to the size of the liquid container, in a state where the liquid container is supported on the support surface of the liquid container tray, the movable wall can be caused to come into contact with the liquid container. Accordingly, because the liquid container can be positioned by the movable wall that comes into contact with the liquid container in at least one direction on the support surface, the change in orientation and position of the liquid container that is supported on the support surface can be suppressed, even if the size of the liquid container varies.

The liquid ejection device may further include an operation panel, and a paper feed tray that is removably mounted to the casing. The liquid container tray, the operation panel, and the paper feed tray may be provided so as to be stacked in an up-down direction.

When the casing is viewed looking toward the liquid container tray, two or more of the liquid container trays may be provided side by side in a left and right direction.

The liquid ejection device further includes a side wall that protrudes from an edge of the support surface, and a portion of the side wall may be configured by the movable wall.

According to this configuration, as a result of a portion of the side wall that protrudes from the edge of the support surface functioning as the movable wall, the structure of the liquid container tray can be simplified by an amount that corresponds to the movable wall also functioning as the side wall.

The movable wall may be configured to continuously move in one direction on the support surface.

According to this configuration, because the movable wall can be continuously moved in one direction on the support surface, the position of the movable wall can be finely adjusted such that the movable wall comes into contact with the liquid container from one direction, even if the size of the liquid container that is to be supported on the support surface varies.

The movable wall may be configured to engage with a guide groove that extends in one direction on the support surface, and move along the guide groove.

According to this configuration, because the movement of the movable wall in one direction on the support surface is guided by the guide groove, the movement of the movable wall can be performed more accurately.

The liquid container tray may further include a lock mechanism that performs fixing and releasing of the fixing of the movable wall to the support surface based on an operation of an operation portion. According to this configuration, the movable wall configured to move on the support surface can be positioned (fixed) at any position in a moving range on the support surface by the lock mechanism based on an operation of the operation portion. On the other hand, when the fixing of the movable wall to the support surface by the lock mechanism is released based on an operation of the operation portion, the movable wall can be moved on the support surface. Therefore, by merely operating the operation portion of the lock mechanism, the positioning of the movable wall can be performed, or the movable wall is enabled to move.

The support surface of the liquid container tray may be provided with display portions serving as a guide of a moving position at intervals in a moving direction of the movable wall.

According to this configuration, because the position to which the movable wall is to be moved can be determined using the display portions as a guide, the determination can be performed easily.

The movable wall may be constituted by two or more movable walls that are configured to come into contact with the liquid container from one direction and the other direction, respectively, on the support surface.

According to this configuration, as a result of the two or more movable walls coming into contact with the liquid container on the support surface so as to sandwich the liquid container from one direction and the other direction (direction opposite to the one direction), the liquid container can be stably held on the support surface, and change in orientation and position of the liquid container can be effectively suppressed.

The movable wall may be constituted by a pair of movable walls that oppose each other and are configured to, in conjunction with each other, approach and separate from each other.

According to this configuration, as a result of the pair of movable walls being caused to approach or separate from each other so as to come into contact with the liquid container supported on the support surface, the liquid container can be held at the center of the pair of movable walls regardless of the size of the liquid container.

The liquid container tray may be provided with a fixed wall that opposes the movable wall and is configured to sandwich the liquid container between the fixed wall and the movable wall.

According to this configuration, as a result of sandwiching the liquid container on the support surface between the movable wall and the fixed wall, the liquid container can be stably held on the support surface, and change in orientation and position of the liquid container can be effectively suppressed.

The liquid container tray may further include a side wall that protrudes from an edge of the support surface, and a portion of the side wall may be constituted by the fixed wall.

According to this configuration, as a result of a portion of the side wall that protrudes from the edge of the support surface functions as the fixed wall, the structure of the liquid container tray can be simplified by an amount that corresponds to the fixed wall also functioning as the side wall.

In the liquid container tray, the movable wall and the fixed wall may be provided so as to oppose each other on a center line that passes through a center of the support surface and extends along the support surface.

According to this configuration, because the liquid container supported by the support surface can be held on the center line by the fixed wall and the movable wall, a state can be realized in which the liquid container can be held at a position closer to the center on the support surface. In this state, because the position of the center of gravity of the liquid container tray is made closer to the center of the support surface, the liquid container tray is unlikely to incline when the liquid container tray is carried so as to be attached to the liquid ejection device, or the like.

The fixed wall may be provided with a positioning portion for positioning a liquid outlet portion of the liquid container.

According to this configuration, the liquid container can be sandwiched between the fixed wall and the movable wall in a state where the liquid outlet portion is positioned to the positioning portion provided in the fixed wall. Therefore, the liquid container can be held on the support surface between the movable wall and the fixed wall while the liquid outlet portion of the liquid container is reliably positioned by the positioning portion.

In the liquid container tray, an opposing surface of the movable wall that opposes the liquid container may be a rough surface.

According to this configuration, the liquid container is unlikely to slide relative to the opposing surface that is a rough surface when the movable wall is moved to a position at which the opposing surface comes into contact with the liquid container.

In the liquid container tray, an opposing surface of the movable wall that opposes the liquid container may be formed in a shape that conforms to a portion of the liquid container corresponding to the opposing surface.

According to this configuration, when the movable wall is moved to a position at which the opposing surface of the movable wall comes into contact with the liquid container, because the contact area of the opposing surface with the liquid container can be increased, the liquid container is unlikely to slide relative to the opposing surface.

An end of a moving range of the movable wall in the liquid container tray is set on a side of a center with respect to the edge of the support surface.

According to this configuration, the movable wall that has been moved to a position so as to be in contact with the liquid container on the support surface does not protrude out past the edge of the support surface. Therefore, when the liquid container tray is attached to the liquid ejection device in a state where the liquid container is supported on the support surface, the movable wall is unlikely to interfere with components or the like that constitute the liquid ejection device.

The liquid container tray may further include a side wall that protrudes from the edge of the support surface, and the protruding height of the movable wall relative to the support surface may be smaller than the protruding height of the side wall relative to the support surface.

According to this configuration, the movable wall that has been moved to a position so as to be in contact with the liquid container on the support surface does not protrude out past the leading end of the side wall that protrudes from the support surface, in the protruding direction. Therefore, when the liquid container tray is attached to the liquid ejection device in a state where the liquid container is supported on the support surface, the movable wall is unlikely to interfere with components or the like that constitute the liquid ejection device.

In the liquid container tray, the support surface may be configured to support two or more of the liquid containers.

According to this configuration, when the two or more liquid containers are supported on the support surface, change in orientation and position of the liquid containers on the support surface can be suppressed by the movable wall.

Also, a liquid ejection device that solves the aforementioned problem includes a casing, a liquid container tray that can be mounted to the casing and is configured as described above, and a liquid ejection head that ejects liquid supplied from the liquid container supported by the liquid container tray to a medium.

According to this configuration, effects similar to those of the liquid container tray can be achieved in the liquid ejection device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, one embodiment of a liquid container tray will be described with reference to FIGS. 1 to 6.

Figure 1:
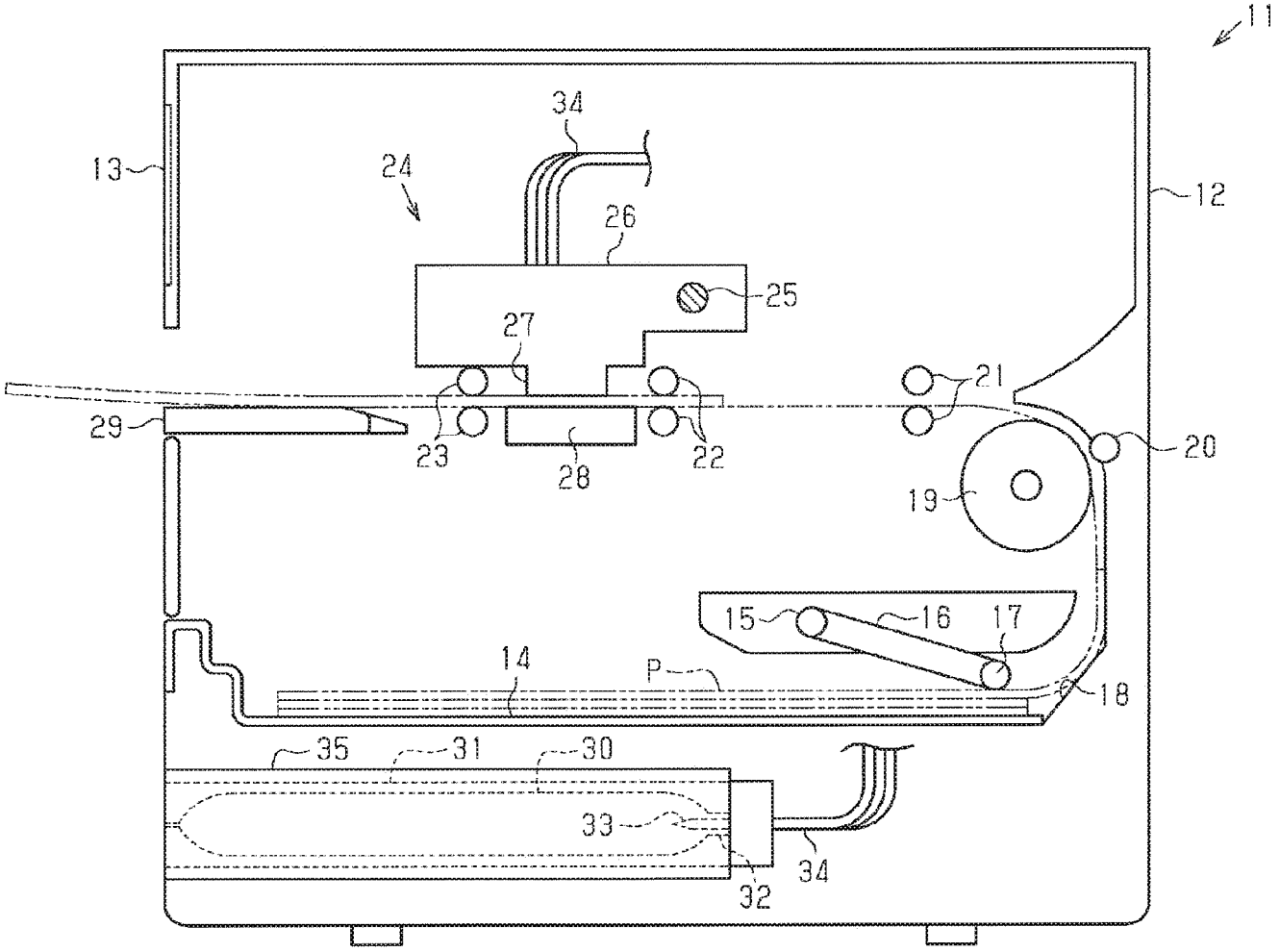
FIG. 1 is a schematic diagram illustrating an overall configuration of a printer.

FIG. 1 schematically shows a printer 11 of inkjet type, which is an example of a liquid ejection device. A paper feed cassette 14 is detachably mounted on a lower side than an operation panel 13, in a casing 12 of the printer 11. Sheets P, which are targets of printing by the printer 11, are housed in the paper feed cassette 14 in a stacked state. A swinging member 16 that is swingable around a swinging shaft 15 is provided above the paper feed cassette 14 in the casing 12. A pickup roller 17 provided at a leading end of the swinging member 16 is in contact with a top-most sheet P housed in the paper feed cassette 14. By rotationally driving the pickup roller 17, the top-most sheet P is fed out to a feeding direction downstream side (right side in the diagram) from the paper feed cassette 14.

A separation portion 18 is provided at a leading end portion on the feeding direction downstream side of the paper feed cassette 14 such that the sheet P being fed out from the paper feed cassette 14 is separated from the lower sheets P in the paper feed cassette 14 mid-way of being fed out. An inversion roller 19 and a separation roller 20 that sandwich the sheet P fed out from the separation portion 18 and again separate the sheet P from the lower sheets P in the paper feed cassette 14 are provided on the feeding direction downstream side (upper side in the diagram) from the separation portion 18 in the casing 12. These inversion roller 19 and the separation roller 20 reliably send the upper-most sheet P in the paper feed cassette 14 to a position between a pair of conveyance rollers 21 by performing the second separation. Furthermore, the sheet P, after being conveyed to a position between a pair of paper feed rollers 22 by rotationally driving the pair of conveyance rollers 21, is conveyed to a position between a pair of paper discharge rollers 23 by rotationally driving the pair of paper feed rollers 22.

A print unit 24 that performs printing on the sheet P is provided between the pair of paper feed rollers 22 and the pair of paper discharge rollers 23 in the casing 12. The print unit 24 includes a carriage 26 that can move along a guide shaft 25 that extends in a direction intersecting a conveyance direction of the sheet P (orthogonal to a paper surface, in this example), the conveyance direction being a direction extending from right to left in the diagram. A recording head 27 for performing printing on the sheet P is provided in a portion of a bottom portion of the carriage 26 that corresponds to a portion between the pair of paper feed rollers 22 and the pair of paper discharge rollers 23. Also, a support base 28 is provided at a position that opposes the recording head 27 in the casing 12, and the sheet P that is conveyed from the pair of paper feed rollers 22 to the pair of paper discharge rollers 23 passes between the recording head 27 and the support base 28.

The printing onto the sheet P by the print unit 24 is realized by ejecting ink onto the sheet P from nozzles of the recording head 27 by appropriately moving the carriage 26 in the extending direction of the guide shaft 25 (scanning direction) while conveying the sheet P from the pair of paper feed rollers 22 to the pair of paper discharge rollers 23. The sheet P onto which printing by the print unit 24 is performed is discharged to a discharge tray 29 provided in the casing 12 after being conveyed to a downstream side (left side in the diagram) in the conveyance direction from the pair of paper discharge rollers 23.

A liquid container tray 31 for holding a liquid container 30 that stores liquid (ink) for printing is provided under the paper feed cassette 14 in the casing 12. Incidentally, a liquid container 30 that is formed in a bag shape is adopted in this example. The liquid container tray 31 is removably attached to the casing 12 of the printer 11, for improving the convenience of replacing the liquid container 30 or the like. Specifically, the liquid container tray 31 can be inserted and removed in the left and right direction in the diagram along a guide wall 35 provided under the paper feed cassette 14 in the casing 12.

The liquid container tray 31 is attached to the casing 12 by being inserted into the casing 12. When the liquid container tray 31 is attached to the casing 12, a liquid outlet portion 32 of the liquid container 30 that is held by the liquid container tray 31 is connected to a liquid supply needle 33 provided in the casing 12. The liquid supply needle 33 is connected to the recording head 27 via a tube 34. Accordingly, when the liquid container tray 31 is attached to the casing 12, the ink in the liquid container 30 that is held by the liquid container tray 31 is supplied to the recording head 27 via the liquid supply needle 33 and the tube 34.

On the other hand, when the liquid container 30 is replaced, the liquid outlet portion 32 of the liquid container 30 that is held by the liquid container tray 31 is separated from the liquid supply needle 33 by removing the liquid container tray 31 from the casing 12. Thereafter, the old liquid container 30 is taken out from the liquid container tray 31, and the liquid container tray 31, in a state where a new liquid container 30 is held by the liquid container tray 31, is attached to the casing 12 as described above, and thus the ink in the new liquid container 30 is supplied to the recording head 27 via the liquid supply needle 33 and the tube 34.

Figure 2:
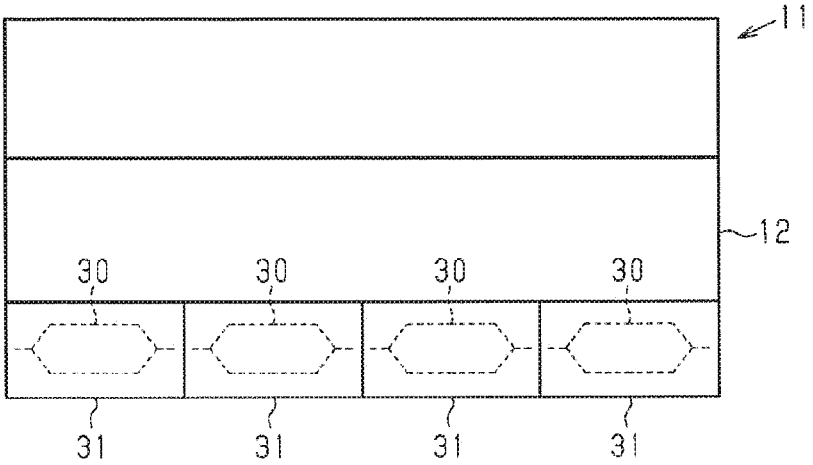
FIG. 2 is a schematic diagram illustrating an arrangement of a liquid container tray in the printer.

As shown in FIG. 2, two or more liquid container trays 31 are provided side by side in a left and right direction in the diagram in the printer 11 according to colors of ink used for printing. In this example, a liquid container 30 that stores black ink is stored in a left end liquid container tray 31, and a liquid container 30 that stores cyan ink is held by a liquid container tray 31 on a right side of the previous liquid container tray 31. Furthermore, a liquid container 30 that stores magenta ink is held by a liquid container tray 31 on the right side of the previous liquid container tray 31, and a liquid container 30 that stores yellow ink is held by a liquid container tray 31 on the right side of the previous liquid container tray 31.

Figure 3:
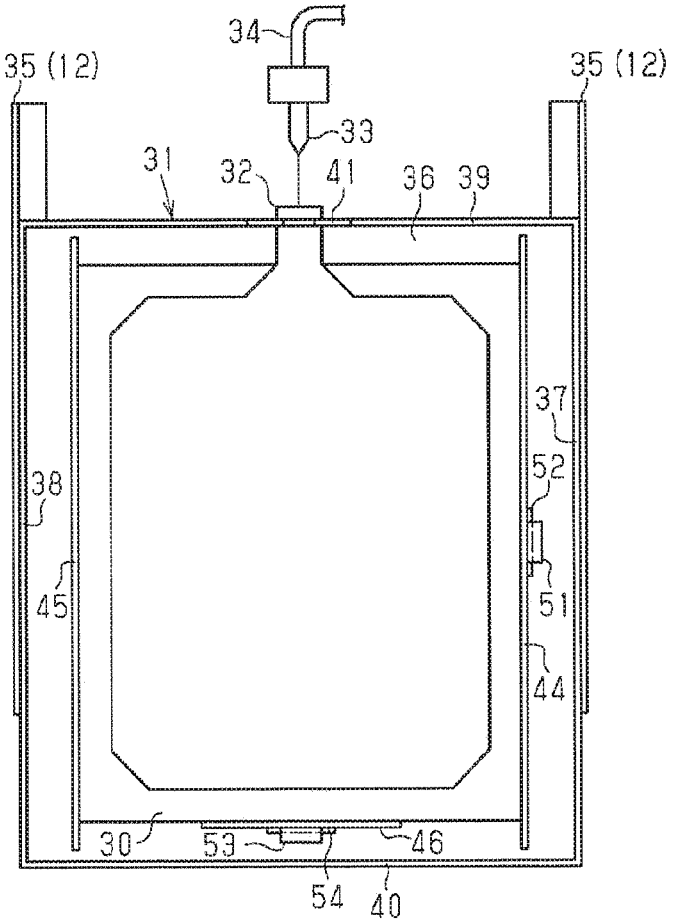
FIG. 3 is a plan view illustrating the liquid container tray and a liquid container.

FIG. 3 shows a state in which the liquid container tray 31 that is being attached to the casing 12 is viewed from the above. The liquid container tray 31 includes a support surface 36 that can support the liquid container 30. The support surface 36 is formed in a square shape, and side walls 37, 38, 39, and 40 are provided so as to protrude upward from the support surface 36 at respective edges (corresponding to respective sides of the square) of the support surface 36. Therefore, the support surface 36 is in a state of being surrounded by the side walls 37, 38, 39, and 40, the side wall 37 and the side wall 38 are positioned so as to oppose each other, and the side wall 39 and the side wall 40 are positioned so as to oppose each other.

A positioning portion 41 for positioning the liquid outlet portion 32 of the liquid container 30 is formed in the side wall 39. The liquid container 30 is placed on a portion of the support surface 36 of the liquid container tray 31 that is surrounded by the side walls 37, 38, 39, and 40. Thereafter, the liquid outlet portion 32 of the liquid container 30 is positioned by the positioning portion 41 of the side wall 39. The casing 12 is provided with a pair of the guide walls 35 that are in parallel. As a result of inserting the liquid container tray 31 between the pair of guide walls 35 in a state where the side wall 39 is faced toward the liquid supply needle 33 side, the liquid container tray 31 is attached to the casing 12 and the liquid outlet portion 32 is connected to the liquid supply needle 33.

Figure 4:
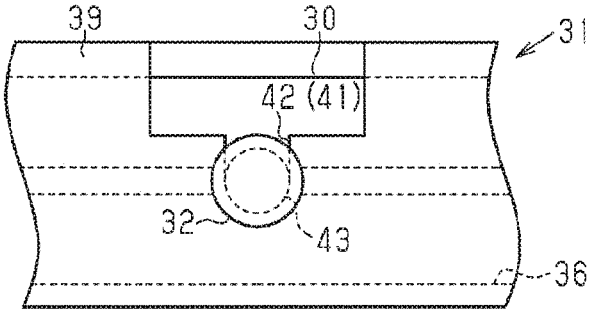
FIG. 4 is a side view illustrating a positioning portion of the liquid container tray and a liquid outlet portion of the liquid container.

FIG. 4 shows a state of the positioning portion 41 and the liquid outlet portion 32 in FIG. 3 viewed from the liquid supply needle 33 side. As shown in FIG. 4, a slit 42 that extends downward from an upper end of the side wall 39 is formed in the positioning portion 41. Meanwhile, the liquid outlet portion 32 is formed in a cylindrical shape having a center line extending in a horizontal direction in a state where the liquid container 30 is placed on the support surface 36. A groove 43 that extends in a ring shape is formed on an outer circumference surface of the liquid outlet portion 32. The width of a portion of the liquid outlet portion 32 corresponding to the groove 43 is equal to the width of the slit 42.

The liquid outlet portion 32 can be positioned to the positioning portion 41 by inserting the portion of the liquid outlet portion 32 corresponding to the groove 43 into the slit 42 from the above. On the other hand, the positioning of the liquid outlet portion 32 by the positioning portion 41 can be released by removing the liquid outlet portion 32 from the slit 42 by displacing it upward from a state in which the portion of the liquid outlet portion 32 corresponding to the groove 43 is inserted into the slit 42.

Next, a detailed structure of the liquid container tray 31 will be described.

When a liquid container 30 that is smaller than that shown in FIG. 3 is used, a gap may be formed between the liquid container 30 that is supported on the support surface 36 of the liquid container tray 31 and the side walls 37, 38, and 40. In the case where such a gap is formed, when the liquid container tray 31 is attached to the printer 11 or the like, the orientation and the position of the liquid container 30 may change due to the gap, and the change may adversely affect the supply state of the ink from the liquid container 30. In order to deal with such a problem, the liquid container tray 31 includes a mechanism that suppresses the change in orientation and position of the liquid container 30 that is supported on the support surface 36.

Figure 5:
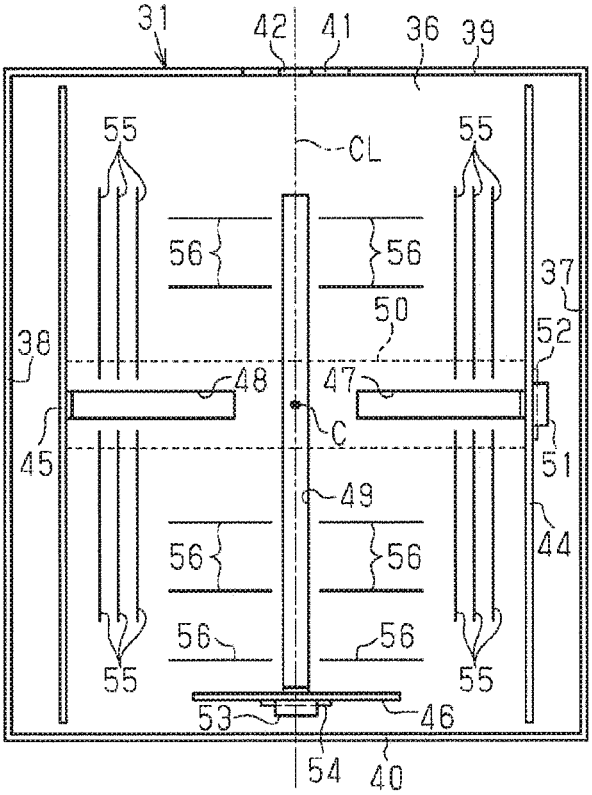
FIG. 5 is a plan view illustrating the liquid container tray.

As shown in FIG. 5, the liquid container tray 31 includes movable walls 44, 45, and 46 that each can move at least one direction on the support surface 36. These movable walls 44, 45, and 46 constitute a portion of the mechanism that suppresses the change in orientation and position of the liquid container 30 (FIG. 3) on the support surface 36.

The movable wall 44 is provided between the side wall 37 and a center C of the support surface 36, and the movable wall 45 is provided between the side wall 38 and the center C of the support surface 36. These movable walls 44 and 45 are in parallel with a center line CL that passes through the center C of the support surface 36 and the positioning portion 41 (slit 42) of the side wall 39 and extends along the support surface 36, and oppose each other in a direction that is orthogonal to the center line CL.

The movable wall 44 engages with a guide groove 47 that extends so as to be orthogonal to the center line CL on the support surface 36, and can continuously move along the guide groove 47 in a left and right direction in FIG. 5. The movable wall 44 approaches the liquid container 30 (FIG. 3) on the support surface 36 by moving in the left direction (one direction) in FIG. 5. On the other hand, the movable wall 44 separates from the liquid container 30 by moving in the right direction in FIG. 5 (the other direction: a direction opposite to the one direction).

The movable wall 45 engages with a guide groove 48 that extends so as to be orthogonal to the center line CL on the support surface 36, and can continuously move along the guide groove 48. The movable wall 45 approaches the liquid container 30 (FIG. 3) on the support surface 36 by moving in the right direction (one direction) in FIG. 5. On the other hand, the movable wall 45 separates from the liquid container 30 by moving in the left direction in FIG. 5 (the other direction: a direction opposite to the one direction).

These movable walls 44 and 45 are connected via an interlocking mechanism 50 that is provided on a side opposite to the support surface 36 in the liquid container tray 31, and approach and separate from each other in conjunction with each other due to the interlocking mechanism 50. Note that the movable walls 44 and 45 that operate this way function as two or more movable walls that come into contact with the liquid container 30 on the support surface 36 so as to sandwich it from the right direction and the left direction in FIG. 5. Also, a surface (left surface in FIG. 5) of the movable wall 44 opposing the liquid container 30 is a rough surface, and a surface (right surface in FIG. 5) of the movable wall 45 opposing the liquid container 30 is also a rough surface.

A lock mechanism 52 that fixes the movable walls 44 and 45 to the support surface 36 and performs releasing of the fixing based on an operation of an operation lever 51 is provided in a portion of the movable wall 44 corresponding to the guide groove 47. Note that the operation lever 51 functions as an operation portion that is operated by a user to perform the fixing and releasing of the fixing by the lock mechanism 52. Line-shaped display portions 55 serving as a guide of moving positions of the movable walls 44 and 45 are provided on the support surface 36 of the liquid container tray 31 at intervals in the left and right direction in FIG. 5 that is a moving direction of the movable walls 44 and 45. Therefore, the user can determine positions to which the movable walls 44 and 45 are to be moved using the display portions 55 as a guide, and can perform fixing of the movable walls 44 and 45 by the lock mechanism 52 at the positions.

The movable wall 46 is provided so as to extend along the side wall 40 between the side wall 40 and the center C of the support surface 36, and is orthogonal to the center line CL. The movable wall 46 engages with a guide groove 49 that extends along the center line CL on the support surface 36, and can continuously move in an up and down direction in FIG. 5 along the guide groove 49. The movable wall 46 approaches the liquid container 30 on the support surface 36 (FIG. 3) by moving upward direction (one direction) in FIG. 5. On the other hand, the movable wall 46 separates from the liquid container 30 by moving downward direction (the other direction: opposite direction to the one direction) in FIG. 5.

The movable wall 46 and the side wall 39 oppose each other on the center line CL, and can sandwich the liquid container 30 on the support surface 36 therebetween. Accordingly, the side wall 39 functions as a fixed wall that opposes the movable wall 46 and can sandwich the liquid container 30 between itself and the movable wall 46. In this regard, some (side wall 39) of the side walls 37, 38, 39, and 40 can be said to be configured by a fixed wall. Note that, a surface (upper surface in FIG. 5) of the movable wall 46 opposing the liquid container 30 is a rough surface.

A lock mechanism 54 that fixes the movable wall 46 to the support surface 36 and performs releasing of the fixing based on an operation of an operation lever 53 is provided in a portion of the movable wall 46 corresponding to the guide groove 49. Note that the operation lever 53 functions as an operation portion that is operated by the user for performing the fixing and releasing the fixing by the lock mechanism 54. Line-shaped display portions 56 serving as a guide of moving position of the movable wall 46 are provided on the support surface 36 of the liquid container tray 31 at intervals in the up and down direction in FIG. 5 that is a moving direction of the movable wall 46. Therefore, the user can determine position to which the movable wall 46 is to be moved using the display portions 56 as a guide, and can perform fixing of the movable wall 46 by the lock mechanism 54 at the position.

Figure 6:
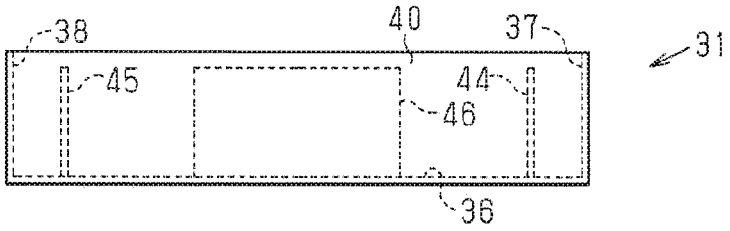
FIG. 6 is a side view illustrating a protruding height of a movable wall in the liquid container tray.

As shown in FIG. 6, the protruding height of the movable walls 44, 45, and 46 relative to the support surface 36 is smaller than the protruding height of the side walls 37, 38, 39, and 40 relative to the support surface 36. Therefore, leading ends of the movable walls 44, 45, and 46 in the protruding direction do not protrude out past (upper side) the leading ends of the side walls 37, 38, 39, and 40 in the protruding direction. When the liquid container tray 31 is attached to the printer 11, the movable walls 44, 45, and 46 are unlikely to interfere with components or the like that constitute the printer 11.

Next, operations of the liquid container tray 31 will be described.

When the liquid container 30 is placed on the support surface 36 of the liquid container tray 31 in the case where the liquid container 30 is to be replaced or the like, first the liquid outlet portion 32 of the liquid container 30 is positioned to the positioning portion 41 of the side wall 39. Then, positioning of the liquid container 30 on the support surface 36 is performed by the movable walls 44, 45, and 46.

That is, as a result of moving the movable walls 44, 45, and 46 in a state where the liquid container 30 is supported on the support surface 36 of the liquid container tray 31, while selecting positions at which the movable walls 44, 45, and 46 come into contact with the liquid container 30 according to the size of the liquid container 30, the movable walls 44, 45, and 46 are caused to come into contact with the liquid container 30. Since the liquid container 30 can be positioned by the movable walls 44, 45, and 46 that come into contact with the liquid container 30 in this way, change in orientation and position of the liquid container 30 can be suppressed even if the size of the liquid container 30 supported on the support surface 36 varies.

The detailed positioning of the liquid container 30 on the support surface 36 by the movable walls 44, 45, and 46 is performed according to the following procedure.

In a state where the fixing of the movable walls 44 and 45 to the support surface 36 by the lock mechanism 52 is released based on an operation of the operation lever 51, the movable walls 44 and 45 are continuously moved along the guide grooves 47 and 48 using the display portions 55 as a guide so as to come into contact with the liquid container 30 on the support surface 36. Here, the movable walls 44 and 45 come into contact with the liquid container 30 so as to sandwich the liquid container 30 therebetween in a direction in which the guide grooves 47 and 48 extend, as a result of the movable walls 44 and 45 being caused to, in conjunction with each other, approach or separate from each other. Thereafter, the movable walls 44 and 45 are fixed to the support surface 36 by the lock mechanism 52 based on an operation of the operation lever 51.

Furthermore, in a state where the fixing of the movable wall 46 to the support surface 36 by the lock mechanism 54 is released based on an operation of the operation lever 53, the movable wall 46 is continuously moved along the guide groove 49 using the display portions 56 as a guide so as to come into contact with the liquid container 30 on the support surface 36. Here, the movable wall 46 comes into contact with the liquid container 30 so as to sandwich the liquid container 30 between itself and the side wall 38 (fixed wall) in a direction in which the guide groove 49 (center line CL) extends as a result of the movable wall 46 being caused to approach or separate from the side wall 39. Thereafter, the movable wall 46 is fixed to the support surface 36 by the lock mechanism 54 based on an operation of the operation lever 53.

According to the present embodiment described above in detail, the following effects are obtained.

(1) Even if the size of the liquid container 30 varies, as a result of the liquid container 30 being positioned by causing the movable walls 44, 45, and 46 to come into contact with the liquid container 30 on the support surface 36, the change in orientation and position of the liquid container 30 can be suppressed.

(2) The movable walls 44, 45, and 46 can be continuously moved when the movable walls 44, 45, and 46 are caused to come into contact with the liquid container 30 on the support surface 36. Accordingly, even if the size of the liquid container 30 varies, the positions of the movable walls 44, 45, and 46 can be finely adjusted so as to come into contact with such a liquid container 30.

(3) The aforementioned movements of the movable walls 44, 45, and 46 are performed along the guide grooves 47, 48, and 49 on the support surface 36. In other words, the movements of the movable walls 44, 45, and 46 are guided by the guide grooves 47, 48, and 49. Therefore, the movements of the movable walls 44, 45, and 46 can be performed more appropriately.

(4) When the movable walls 44, 45, and 46 are moved so as to come into contact with the liquid container 30, because the positions to which the movable walls 44, 45, and 46 are to be moved can be determined using the display portions 55 and 56 on the support surface 36 as a guide, the determination can be performed easily.

(5) The movable walls 44 and 45 can be fixed (positioned) to the support surface 36 by the lock mechanism 52 based on an operation of the operation lever 51. On the other hand, when the fixing of the movable walls 44 and 45 to the support surface 36 by the lock mechanism 52 is released based on an operation of the operation lever 51, the movable walls 44 and 45 can be moved on the support surface 36. Accordingly, the movable walls 44 and 45 can be positioned, or the movable walls 44 and 45 can be moved by merely operating the operation lever 51 of the lock mechanism 52.

(6) The movable wall 46 can be fixed (positioned) to the support surface 36 by the lock mechanism 54 based on an operation of the operation lever 53. On the other hand, when the fixing of the movable wall 46 to the support surface 36 by the lock mechanism 54 is released based on an operation of the operation lever 53, the movable wall 46 can be moved on the support surface 36. Accordingly, the movable wall 46 can be positioned, or the movable wall 46 can be moved by merely operating the operation lever 53 of the lock mechanism 54.

(7) The movable wall 44 is caused to come into contact with the liquid container 30 on the support surface 36 by being moved in one direction (left direction in FIG. 3). Meanwhile, the movable wall 45 is caused to come into contact with the liquid container 30 on the support surface 36 by being moved in the other direction (right direction in FIG. 3: direction opposite to the one direction). As a result of sandwiching the liquid container 30 with the movable walls 44 and 45, the liquid container 30 can be held stably on the support surface 36, and the change in orientation and position of the liquid container 30 can be effectively suppressed.

(8) Since the movable walls 44 and 45 come into contact with the liquid container 30 on the support surface 36 as a result of the movable walls 44 and 45, in conjunction with each other, approaching or separating from each other, the liquid container 30 can be held at the center between the movable wall 44 and the movable wall 45 regardless of the size of the liquid container 30.

(9) As a result of sandwiching the liquid container 30 on the support surface 36 between the movable wall 46 and the side wall 39 (fixed wall), the liquid container 30 can be stably held on the support surface 36, and the change in orientation and position of the liquid container 30 can be effectively suppressed.

(10) Some of the side walls 37, 38, 39, and 40 (side wall 39) that protrude from edges of the support surface 36 function as the fixed wall that sandwich the liquid container 30 between itself and the movable wall 46. The structure of the liquid container tray 31 can be simplified by an amount that corresponds to the fixed wall also functioning as the side wall.

(11) Since the movable wall 46 and the side wall 39 are provided so as to oppose each other on the center line CL, a state is realized in which the liquid container 30 is held at a position closer to the center of the support surface 36 (closer to the center line CL) as a result of sandwiching the liquid container 30 between the movable wall 46 and the side wall 39. In this state, because the position of the center of gravity of the liquid container tray 31 is made closer to the center of the support surface 36, the liquid container tray 31 is unlikely to incline when the liquid container tray 31 is carried so as to be attached to the printer 11, or the like.

(12) The side wall 39 is provided with the positioning portion 41 for positioning the liquid outlet portion 32 of the liquid container 30, and the liquid container 30 is sandwiched between the side wall 39 and the movable wall 46 in a state where the liquid outlet portion 32 is positioned to the positioning portion 41. Therefore, the liquid container 30 can be held on the support surface 36 between the movable wall 46 and the side wall 39 while the liquid outlet portion 32 of the liquid container 30 is reliably positioned by the positioning portion 41.

(13) When the movable walls 44, 45, and 46 move and come into contact with the liquid container 30 on the support surface 36, opposing surfaces of the movable walls 44, 45, and 46 that oppose the liquid container 30 come into contact with the liquid container 30. Since the opposing surfaces are rough surfaces, the liquid container 30 is unlikely to slide relative to the opposing surfaces when the movable walls 44, 45, and 46 are moved such that the opposing surfaces come into contact with the liquid container 30.

(14) The right end in the moving range of the movable wall 44 in FIG. 5 is set on a side of the center, that is closer to the center line CL, with respect to the side wall 37 that exists at a right edge of the support surface 36. Also, the left end in the moving range of the movable wall 45 in FIG. 5 is set on a side of the center, that is closer to the center line CL, with respect to the side wall 38 that exists at a left edge of the support surface 36. Furthermore, the lower end in the moving range of the movable wall 46 in FIG. 5 is set on a side of the center, that is closer to the center C, with respect to the side wall 40 that exists at a lower edge of the support surface 36. Therefore, the movable walls 44, 45, and 46 that have been moved to positions so as to be in contact with the liquid container 30 on the support surface 36 do not protrude out past the edges of the support surface 36. Therefore, when the liquid container tray 31 is attached to the printer 11 in a state where the liquid container 30 is supported on the support surface 36, the movable walls 44, 45, and 46 are unlikely to interfere with components or the like that constitute the printer 11.

(15) The protruding heights of the movable walls 44, 45, and 46 relative to the support surface 36 are smaller than the protruding heights of the side walls 37, 38, 39, and 40 relative to the support surface 36. Therefore, the leading ends of the movable walls 44, 45, and 46 in the protruding direction do not protrude out past (upper side) the leading ends of the side walls 37, 38, 39, and 40 in the protruding direction, and the movable walls 44, 45, and 46 are unlikely to interfere with components or the like that constitute the printer 11 when the liquid container tray 31 is attached to the printer 11.

Note that the aforementioned embodiment can be changed as follows, for example.

The support surface 36 of the liquid container tray 31 may be configured to support two or more liquid containers 30. In this case, the movable walls 44, 45, and 46 are moved such that at least one of the movable walls 44, 45, and 46 come into contact with each of the two or more liquid containers 30 on the support surface 36. In this case, when the two or more liquid containers 30 are supported on the support surface 36, the change in orientation and position of the liquid containers 30 on the support surface 36 can be suppressed by the movable walls 44, 45, and 46.

Figure 7:
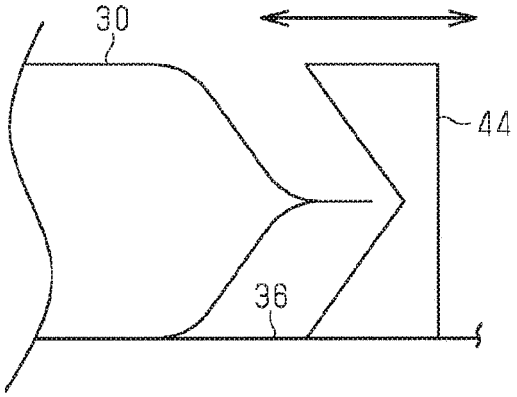
FIG. 7 is a schematic diagram illustrating another example of an opposing surface of a movable wall that opposes the liquid container.
Figure 8:
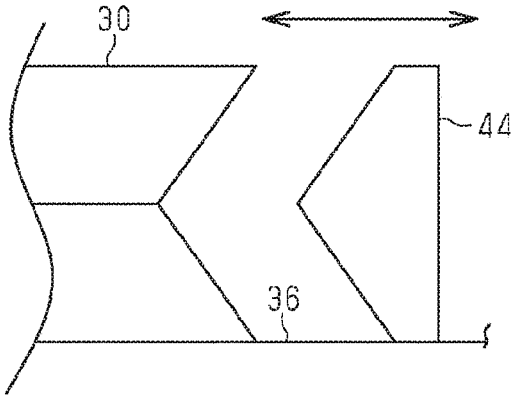
FIG. 8 is a schematic diagram illustrating another example of the opposing surface of the movable wall that opposes the liquid container.

As shown in FIGS. 7 and 8, the opposing surface of the movable wall 44 that opposes the liquid container 30 on the support surface 36 may be formed in a shape that conforms to a portion of the liquid container 30 that corresponds to the opposing surface. Similarly, the opposing surfaces of the movable walls 45 and 46 that oppose the liquid container 30 on the support surface 36 may be each formed in a shape that conforms to a portion of the liquid container 30 that corresponds to the opposing surface. In this case, when the movable walls 44, 45, and 46 are moved to positions at which the opposing surfaces of the movable walls 44, 45, and 46 come into contact with the liquid container 30, because the contact area of the opposing surfaces with the liquid container 30 can be increased, the liquid container 30 is unlikely to slide relative to the opposing surfaces.

The opposing surfaces of the movable walls 44, 45, and 46 that oppose the liquid container 30 on the support surface 36 need not be rough surfaces, and can be smooth surfaces.

Although the side wall 39 that extends over the entire length of one side of the support surface 36 is caused to function as the fixed wall, a fixed wall that opposes the movable wall 46 on the center line CL may be provided separately while omitting the side wall 39.

The movable wall 46 of the movable walls 44, 45, and 46 may be omitted.

Although the movable wall 44 and the movable wall 45 are configured to be interlocked so as to approach or separate from each other by the interlocking mechanism 50, the movable wall 44 and the movable wall 45 need not to be interlocked, and may move individually. In the case where the movable wall 44 and the movable wall 45 are configured to move individually, it is conceivable that one of the movable wall 44 and the movable wall 45 is omitted.

The display portions 55 and 56 need not be shaped in a line, and may be marks.

The display portions 55 and 56 need not be provided.

The lock mechanisms 52 and 54 need not be provided.

Instead of forming the guide grooves 47, 48, and 49 on the support surface 36, two or more holes may be formed in a line at predetermined intervals along each of the directions in which the guide grooves 47, 48, and 49 extend, and a pin that can be inserted into the holes may be provided in each of the movable walls 44, 45, and 46. In this case, as a result of inserting the pin of the movable wall 44 into one of the holes that form a line in a direction in which the guide groove 47 extends, the movable wall 44 can be positioned at a position at which the movable wall 44 comes into contact with the liquid container 30 in the direction. Also, as a result of inserting the pin of the movable wall 45 into one of the holes that form a line in a direction in which the guide groove 48 extends, the movable wall 45 can be positioned at a position at which the movable wall 45 comes into contact with the liquid container 30 in the direction. Furthermore, as a result of inserting the pin of the movable wall 46 into one of the holes that form a line in a direction in which the guide groove 49 extends, the movable wall 46 can be positioned at a position at which the movable wall 46 comes into contact with the liquid container 30 in the direction.

While omitting the side walls 37, 38, and 40, the movable walls 44, 45, and 46 may play the role of the side walls. This means that a portion of the side walls in the liquid container tray 31 is configured by the movable walls 44, 45, and 46. In this case, the structure of the liquid container tray 31 can be simplified by an amount that corresponds to the movable walls 44, 45, and 46 also functioning as the side walls.

The liquid container 30 is not limited to be formed in a bag shape, and may be formed in a case shape.

The liquid container tray 31 may include an openable/closable cover. In this case, the cover includes a wall that opposes the support surface 36, and covers the liquid container 30 in a state where the liquid container 30 is held on the support surface 36.

The printer 11 is not limited to a type that uses four types of ink, and may be a type that uses one type of ink, a type that uses two types of ink, a type that uses three types of ink, or a type that uses five or more types of ink.

The printer 11 is not limited to an inkjet type, and may be a dot impact printer or a laser printer. Furthermore, the printer 11 is not limited to a serial printer, and may be a line printer or a page printer.

Although the printer 11 is illustrated as the liquid ejection device, the invention may be applied to liquid ejection devices other than the printer 11, that eject or discharge liquid other than ink. The state of liquid that is to be discharged from the liquid ejection devices includes a droplet having a granular shape, a tear-drop shape, and a shape with a thread-like trailing end. The liquid mentioned here need only be a material that can be ejected by liquid ejection devices. For example, the liquid need only be a material in a state where a substance is in a liquid phase, and a liquid material having a high or low viscosity, sol, gel water, and other liquid materials such as an inorganic solvent, a solution, a liquid resin, and a liquid metal (metallic melt) are also included as a liquid. Furthermore, the liquid is not limited to being a single-state substance, and also includes particles of a functional material made from solid matter, such as pigment or metal particles, that are dissolved, dispersed, or mixed in a solvent, or the like. Representative examples of the liquid include ink, liquid crystal, or the like. Here, the ink encompasses general water-based ink and oil-based ink, as well as various types of liquid compositions such as gel ink and hot melt ink.

Although the sheet P is illustrated as a target medium to which liquid in a liquid container is ejected, the medium is not limited to the sheet P, and may be a resin film, a metal foil, a metal film, a composite film (laminate film) of resin and metal, a woven fabric, a nonwoven fabric, a ceramic sheet, or the like.

The entire disclosure of Japanese Patent Application No. 2015-232004, filed Nov. 27, 2015, is expressly incorporated by reference herein.

What is claimed is:

1. A liquid ejection device comprising:

a casing including a guide wall;

a liquid container tray configured to support a liquid container; and a recording head that ejects liquid supplied from the liquid container that is supported by the liquid container tray to a medium, wherein the liquid container tray:

is configured to be inserted to or removed from the casing along the guide wall, and includes a support surface that supports the liquid container and a movable wall configured to move relative to the support surface in at least one direction parallel to the support surface.

2. The liquid ejection device according to claim 1, further comprising:

an operation panel; and a paper feed tray that is removably mounted to the casing, wherein the liquid container tray, the operation panel, and the paper feed tray are provided so as to be stacked in an up-down direction.

3. The liquid ejection device according to claim 1, wherein, when the casing is viewed looking toward the liquid container tray, two or more of the liquid container trays are provided side by side in a left and right direction.

4. The liquid ejection device according to claim 1, further comprising:

a side wall that protrudes from an edge of the support surface, wherein a portion of the side wall is configured by the movable wall.

5. The liquid ejection device according to claim 1, wherein the movable wall is configured to continuously move in one direction on the support surface.

6. The liquid ejection device according to claim 1, wherein the movable wall is configured to engage with a guide groove that extends in one direction on the support surface, and move along the guide groove.

7. The liquid ejection device according to claim 1, further comprising:

a lock mechanism that performs fixing and releasing of the fixing of the movable wall to the support surface based on an operation of an operation portion.

8. The liquid ejection device according to claim 1, wherein the support surface is provided with display portions serving as a guide of a moving position at intervals in a moving direction of the movable wall.

9. The liquid ejection device according to claim 1, wherein the movable wall is constituted by two or more movable walls that are configured to come into contact with the liquid container from one direction and the other direction, respectively, on the support surface.

10. The liquid ejection device according to claim 9, wherein the movable wall is constituted by a pair of movable walls that oppose each other and are configured to, in conjunction with each other, approach and separate from each other.

11. The liquid ejection device according to claim 1, wherein a fixed wall configured to sandwich the liquid container between the fixed wall and the movable wall is provided so as to oppose the movable wall.

12. The liquid ejection device according to claim 11, further comprising:

a side wall that protrudes from an edge of the support surface, wherein a portion of the side wall is constituted by the fixed wall.

13. The liquid ejection device according to claim 11, wherein the movable wall and the fixed wall are provided so as to oppose each other on a center line that passes through a center of the support surface and extends along the support surface.

14. The liquid ejection device according to claim 11, wherein the fixed wall is provided with a positioning portion for positioning a liquid outlet portion of the liquid container.

15. The liquid ejection device according to claim 1, wherein an opposing surface of the movable wall that opposes the liquid container is a rough surface.

16. The liquid ejection device according to claim 1, wherein an opposing surface of the movable wall that opposes the liquid container is formed in a shape that conforms to a portion of the liquid container corresponding to the opposing surface.

17. The liquid ejection device according to claim 1, wherein an end of a moving range of the movable wall is set on a side of a center with respect to an edge of the support surface.

18. The liquid ejection device according to claim 1, further comprising:

a side wall that protrudes from an edge of the support surface, wherein a protruding height of the movable wall relative to the support surface is smaller than a protruding height of the side wall relative to the support surface.

19. The liquid ejection device according to claim 1, wherein the support surface is configured to support two or more of the liquid containers.

* * * * *